US007773726B2

(12) United States Patent
Inazuru

(10) Patent No.: US 7,773,726 B2
(45) Date of Patent: Aug. 10, 2010

(54) X-RAY TUBE AND X-RAY SOURCE

(75) Inventor: Tutomu Inazuru, Hamamatsu (JP)
(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.
(21) Appl. No.: 11/793,306
(22) PCT Filed: Dec. 9, 2005
(86) PCT No.: PCT/JP2005/022694
§ 371 (c)(1),
(2), (4) Date: Jun. 19, 2007
(87) PCT Pub. No.: WO2006/070586
PCT Pub. Date: Jul. 6, 2006
(65) Prior Publication Data
US 2008/0107237 A1 May 8, 2008
(30) Foreign Application Priority Data
Dec. 27, 2004 (JP) ..... 2004-377775
(51) Int. Cl.
*H01J 35/02* (2006.01)
(52) U.S. Cl. ..... 378/139; 378/119; 378/121; 378/143
(58) Field of Classification Search ..... 378/102, 378/139, 119, 121, 143
See application file for complete search history.

(56) References Cited

U.S. PATENT DOCUMENTS 2,431,277 A * 11/1947 Pressel et al. ..... 174/50.63

(Continued)

FOREIGN PATENT DOCUMENTS

CN 1069438 C 8/2001

(Continued)

OTHER PUBLICATIONS

English machine translation of Inazuru et al. (JP 2003-132826, publication date May 9, 2003), 12 pages.*

(Continued)

*Primary Examiner*—Hoon Song
*Assistant Examiner*—Mona M Sanei
(74) *Attorney, Agent, or Firm*—Drinker Biddle & Reath LLP

(57) ABSTRACT

In an X-ray source 1 and an X-ray tube 4, there is formed a shield portion 42 adapted to shield the portion W where a target support body 18 and an opening portion 34 on the other end side of a valve 20 are fixed to each other when viewed from the one end side of the valve 20. Therefore, the generation of discharge between the one end side of the valve 20 and the fixation portion W can be suppressed. Also, the other end portion of the valve 20 is formed as a narrowed portion 37 and the opening portion 34 on the other end side of the valve 20 is fixed to the target support body 18, whereby the shapes of the valve 20 and the shield portion 42 can be made simpler than in conventional X-ray tubes in which an inner cylindrical portion is formed in a valve. Such a simple structure can improve the stability of an electric field in the valve 20 when generating X-rays and thereby achieve an effective suppression of the generation of discharge in the valve 20.

17 Claims, 6 Drawing Sheets

U.S. PATENT DOCUMENTS

| | | | | |
|---|---|---|---|---|
| 2,845,559 | A | | 7/1958 | Lempert |
| 4,322,653 | A | | 3/1982 | Bader et al. |
| 5,077,771 | A | * | 12/1991 | Skillicorn et al. ..... 378/102 |
| 7,031,433 | B2 | | 4/2006 | Suzuki et al. |
| 7,110,505 | B2 | | 9/2006 | Suzuki et al. |

FOREIGN PATENT DOCUMENTS

| | | | | |
|---|---|---|---|---|
| DE | 195 36 247 | | | 4/1997 |
| EP | 1 052 674 | | | 11/2000 |
| EP | 1 437 757 | | | 7/2004 |
| JP | 37-28601 | | | 10/1962 |
| JP | 50-092669 | | | 8/1975 |
| JP | 62259397 | A | * | 11/1987 |
| JP | 2000-268753 | | | 9/2000 |
| JP | 2003-132826 | | | 5/2003 |
| JP | 2003132826 | | * | 5/2003 |
| JP | 2004-207161 | | | 7/2004 |
| WO | WO 03/036676 | | | 5/2003 |

OTHER PUBLICATIONS

English machine translation of Suzuki et al. (JP 2004-207161, publication date Jul. 22, 2004), 10 pages.*

* cited by examiner

X-RAY TUBE AND X-RAY SOURCE

TECHNICAL FIELD

The present invention relates to an X-ray tube to be incorporated in, for example, an X-ray generator for use in nondestructive tests and an X-ray source using the same.

BACKGROUND ART

X-ray tubes are for bringing electrons emitted from an electron gun into collision with a target to generate X-rays. One of conventional X-ray tubes is described in Patent Document 1, for example. This X-ray tube includes a vacuum enclosure with a valve joining the enclosure main body for housing an electron gun, in the vacuum enclosure inserted is a target support body for supporting a target therein. The valve is formed with an inner cylindrical portion in a way that the leading end portion thereof is folded wholly inward, and the leading end portion of the inner cylindrical portion is fixed to the target support body. Then, the target support body is provided with a cover for covering the fixation portion where the target support body and the leading end portion of the inner cylindrical portion are fixed to each other to suppress the generation of discharge in the valve.

Patent Document 1: U.S. Pat. No. 5,077,771

DISCLOSURE OF THE INVENTION

Problems to be Solved by the Invention

However, in the above-described conventional X-ray tube, the inner cylindrical portion is formed in the valve, which therefore causes the shape of the cover to be complicated. This kind of complication of X-ray tube structure may promote the generation of discharge in the valve.

The present invention has been made to solve the above-described problems, and an object thereof is to provide an X-ray tube in which the generation of discharge in a valve can be suppressed with a simple structure and an X-ray source using the same.

Means for Solving the Problems

In order to solve the above-described problems, the present invention is directed to an X-ray tube for bringing electrons emitted from an electron gun into collision with a target to generate X-rays, including: an enclosure main body for housing therein the electron gun; a cylindrical valve with an opening portion on one end side thereof being fixed to the enclosure main body, while the other end portion thereof being formed as a narrowed portion; and a target support body inserted in the valve to support the target, in which an opening portion on the other end side of the valve is fixed to the target support body, and a shield portion is formed between the enclosure main body and the opening portion on the other end side, the shield portion being adapted to shield a fixation portion where the target support body and the opening portion on the other end side are fixed to each other when viewed from the one end side of the valve.

In this X-ray tube, the shield portion is formed between the enclosure main body and the opening portion on the other end side of the valve, the shield portion being adapted to shield the fixation portion where the target support body and the opening portion on the other end side are fixed to each other when viewed from the one end side of the valve. This can suppress the generation of discharge between the one end side of the valve and the fixation portion where the target support body and the opening portion on the other end side are fixed to each other. Also, the other end portion of the valve is formed as a narrowed portion and the opening portion on the other end side of the valve is fixed to the target support body, whereby the shapes of the valve and the shield portion can be made simpler than in the conventional X-ray tube in which the inner cylindrical portion is formed in the valve. Such a simple structure can achieve an effective suppression of the generation of discharge. Further, when fixing the target support body and the opening portion on the other end side of the valve, workability and visibility are increased relative to the conventional X-ray tube in which the inner cylindrical portion is formed in the valve, which can also enhance the reliability of X-ray tubes manufactured.

Also, the shield portion is preferably formed integrally with the target support body. In this case, since the number of parts in the valve is reduced, the generation of discharge in the valve can be suppressed more effectively.

Further, the shield portion is preferably formed to have rounded corner portions or have no corner portion. Since this can prevent an electric field from being concentrated locally in the shield portion, the generation of discharge can be suppressed more effectively.

Additionally, it is preferable that the X-ray tube includes a cylindrical member joining the opening portion on the other end side in which the target support body is inserted, wherein the opening portion on the other end side is fixed to the target support body via the cylindrical member. With this arrangement, the target support body can be fine-adjusted along the cylindrical member when fixing the target support body and the opening portion on the other end side of the valve, which allows the target to be aligned accurately with respect to the electron gun.

In addition, the present invention is directed to an X-ray source including a chassis for housing therein the above-described X-ray tube and a high-voltage power supply unit for supplying a voltage to the target support body in the X-ray tube, in which the portion where the target support body and the opening portion on the other end side are fixed to each other is surrounded by a surrounding member.

In this X-ray source, since the above-described X-ray tube is employed, the generation of discharge in the valve can be suppressed effectively. Further, since the fixation portion where the target support body and the opening portion on the other end side of the valve are fixed to each other is surrounded by the surrounding member, the generation of discharge between the chassis and the X-ray tube can be suppressed.

Additionally, it is preferable that the chassis includes an insulating block with the high-voltage power supply unit embedded therein, and a metallic cylindrical portion fixed to the insulating block and filled with insulating liquid material inside, and wherein the valve in the X-ray tube is housed in the cylindrical portion, and the surrounding member surrounds the fixation portion in such a manner that the fixation portion is not seen through from an inner wall of the cylindrical portion.

In this X-ray source, since the radiation performance of the X-ray tube can be improved, when generating X-rays, by fixing the cylindrical portion to the insulating block and housing the valve in the X-ray tube in the cylindrical portion, the generation of discharge in the X-ray tube can be suppressed. Further, since the surrounding member surrounds the fixation portion, the generation of discharge between the cylindrical portion and the X-ray tube can be suppressed.

Further, it is preferable that the surrounding member has a wall portion extending along a tube axis direction of the X-ray tube, and that the wall portion surrounds the fixation portion in such a manner that the fixation portion is not seen through from the inner wall of the cylindrical portion.

In the case above, since the wall portion that extends along the tube axis direction of the X-ray tube surrounds the fixation portion, an electric field in the vicinity of the fixation portion cannot be disturbed, whereby the generation of discharge between the cylindrical portion and the X-ray tube can be suppressed more effectively.

EFFECTS OF THE INVENTION

As described heretofore, in accordance with the X-ray tube and X-ray source according to the present invention, the generation of discharge in the valve can be suppressed with a simple structure.

DESCRIPTION OF THE SYMBOLS

Figure 1:
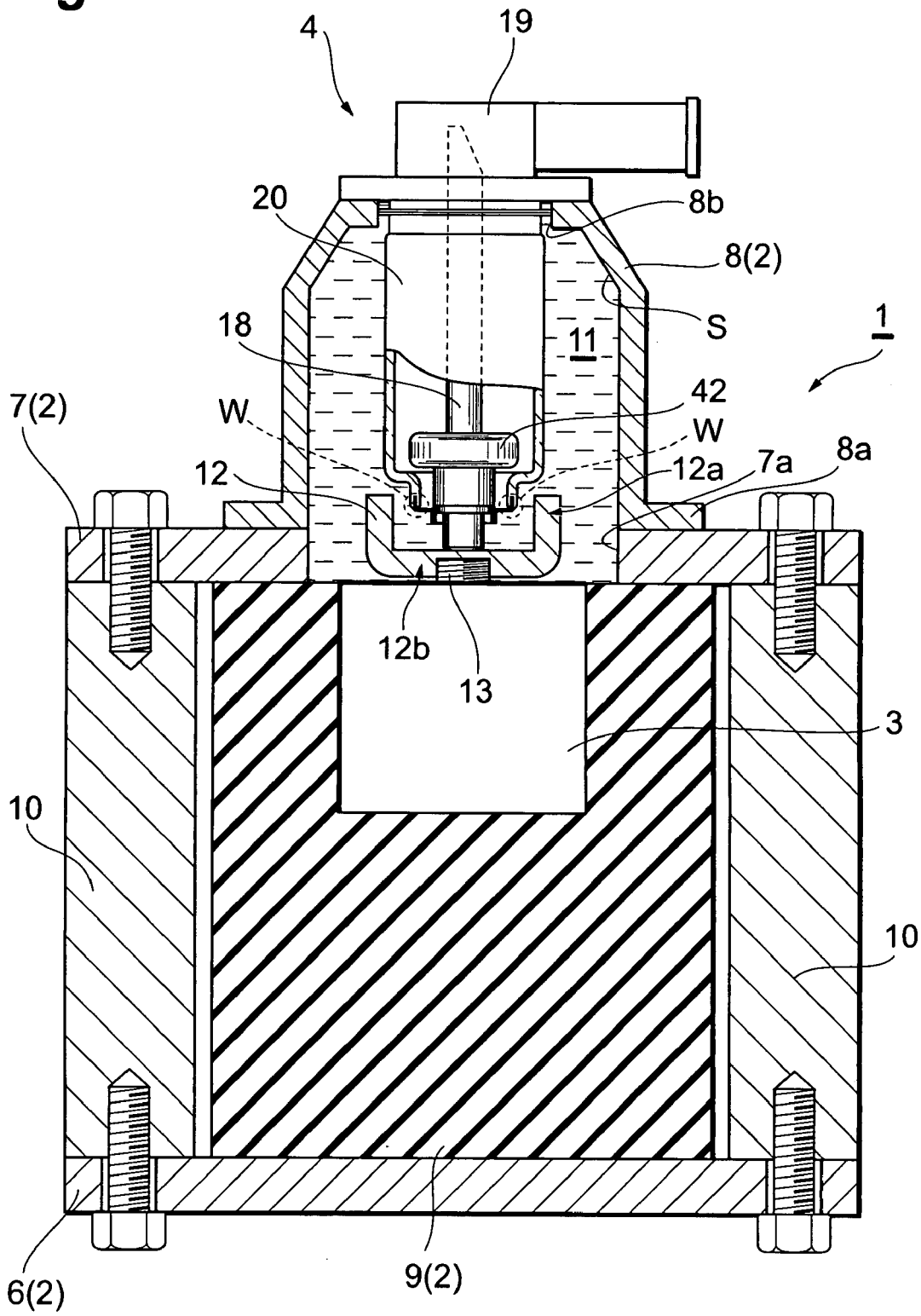
FIG. 1 is a cross-sectional view of an X-ray source according to an embodiment of the present invention.

1: X-ray source; 2: Chassis; 3: High-voltage power supply unit; 4: X-ray tube; 18: Target support body; 19: Enclosure main body; 20: Valve; 32: Opening portion on one end side; 34: Opening portion on the other end side; 37: Narrowed portion (other end portion); 40, 40A, 40B, 41, and 41A: Cylindrical members; 42 and 42A: Shield portions; 42*a*: Corner portion; T: Target; W: Fixation portion

BEST MODES FOR CARRYING OUT THE INVENTION

Preferred embodiments of an X-ray tube and X-ray source according to the present invention will hereinafter be described in detail with reference to the accompanying drawings. It is noted that terms "upper" and "lower" are used for descriptive purposes based on the states shown in the drawings.

FIG. 1 is a cross-sectional view of an X-ray source according to an embodiment of the present invention. As shown in FIG. 1, the X-ray source 1 includes a chassis 2, a high-voltage power supply unit 3, and an X-ray tube 4.

The chassis 2 is comprised of a bottom plate 6, a top plate 7, a cylindrical portion 8, and an insulating block 9. The bottom plate 6 and top plate 7 each have an approximately square shape, and a circular through hole 7*a* is provided in the center of the top plate 7. The corners of the bottom plate 6 and top plate 7 are coupled to each other via spacers 10, and the bottom plate 6 and top plate 7 are fixed to each other with a predetermined spacing therebetween. Also, the bottom plate 6, top plate 7, and the side surfaces of the spacers 10 are covered with side plates (not shown in the drawings) for joining these components.

The cylindrical portion 8 is formed of metal in a circular cylindrical shape with the upper end thereof being tapered, the inside diameter thereof being the same as that of the through hole 7*a* in the top plate 7. An installation flange 8*a* is provided in the lower end portion of the cylindrical portion 8, while a circular opening portion 8*b* for mounting the X-ray tube 4 thereon is formed in the upper end portion. Then, the cylindrical portion 8 is erected in the center of the upper surface of the top plate 7 in such a manner that the inside of the cylindrical portion 8 communicates with the through hole 7*a* in the top plate 7 by fixing the installation flange 8*a* liquid-tightly to the peripheral edge portion of the through hole 7*a* in the top plate 7. It is noted that the cylindrical portion 8 has a ground potential.

The insulating block 9 is formed of insulating resin material such as epoxy resin in an approximately cubic shape, the surface thereof being processed to be covered with conductive material to have a ground potential, such as applying of conductive tape or conductive coating. The insulating block 9 is held between the bottom plate 6 and top plate 7 in such a manner as to cover the through hole 7*a* in the top plate 7 from below. With this arrangement, a housing space S surrounded by the cylindrical portion 8, top plate 7, insulating block 9, and high-voltage power supply unit 3 is formed in the upper part of the chassis 2. It is noted that the housing space S is filled with insulating liquid material such as insulating oil 11.

The X-ray tube 4 is fixed liquid-tightly to the opening portion 8*b* of the cylindrical portion 8 with a valve 20 to be described hereinafter being housed in the housing space S. Also, the leading end portion of a target support body 18 that protrudes from an opening portion 34 on the other end side of the valve 20 (refer to FIG. 2) is fixed with screws to a high-voltage cap (surrounding member) 12 for surrounding the fixation portion W where the opening portion 34 on the other end side and the target support body 18 are fixed to each other.

The high-voltage cap 12 is made of conductive material (e.g. aluminum) and surrounds a portion to seal the valve 20 which is positioned in the vicinity of the leading end portion on the high-voltage power supply unit 3 side of the target support body 18. The high-voltage cap 12 has a circular bottom plate portion 12*b* and a wall portion 12*a* erected on its edge, the central axis thereof being fixed coaxially with the tube axis of the X-ray tube 4. The inside diameter of the wall portion 12*a* is at least greater than the outside diameter of the valve 20 in the vicinity of the fixation portion W. The wall portion 12*a* extends along the tube axis direction of the X-ray tube 4. The wall portion 12*a* shields the fixation portion W in such a manner that the fixation portion W is not seen through from the inner wall of the cylindrical portion 8. In the present embodiment, the high-voltage cap 12 also has the bottom plate portion 12*b* and is fixed coaxially to the target support body 18 with screws in such a manner as to sandwich the bottom plate portion 12*b*, but may be fixed from the wall portion 12*a* side with screws so as to intersect with the axial direction of the target support body 18. In this case, the bottom plate portion 12*b* may not be provided.

The high-voltage power supply unit 3 is embedded in the center in the upper part of the insulating block 9 and is arranged beneath the through hole 7*a* in the top plate 7. The high-voltage power supply unit 3 is connected electrically to the target support body 18 via a compression spring 13 with one end thereof being supported by the high-voltage cap 12 and is adapted to supply a high voltage to the target support body 18 via the compression spring 13 and the high-voltage cap 12.

Next will be described the configuration of the above-described X-ray tube 4 in detail with reference to FIG. 2.

Figure 2:
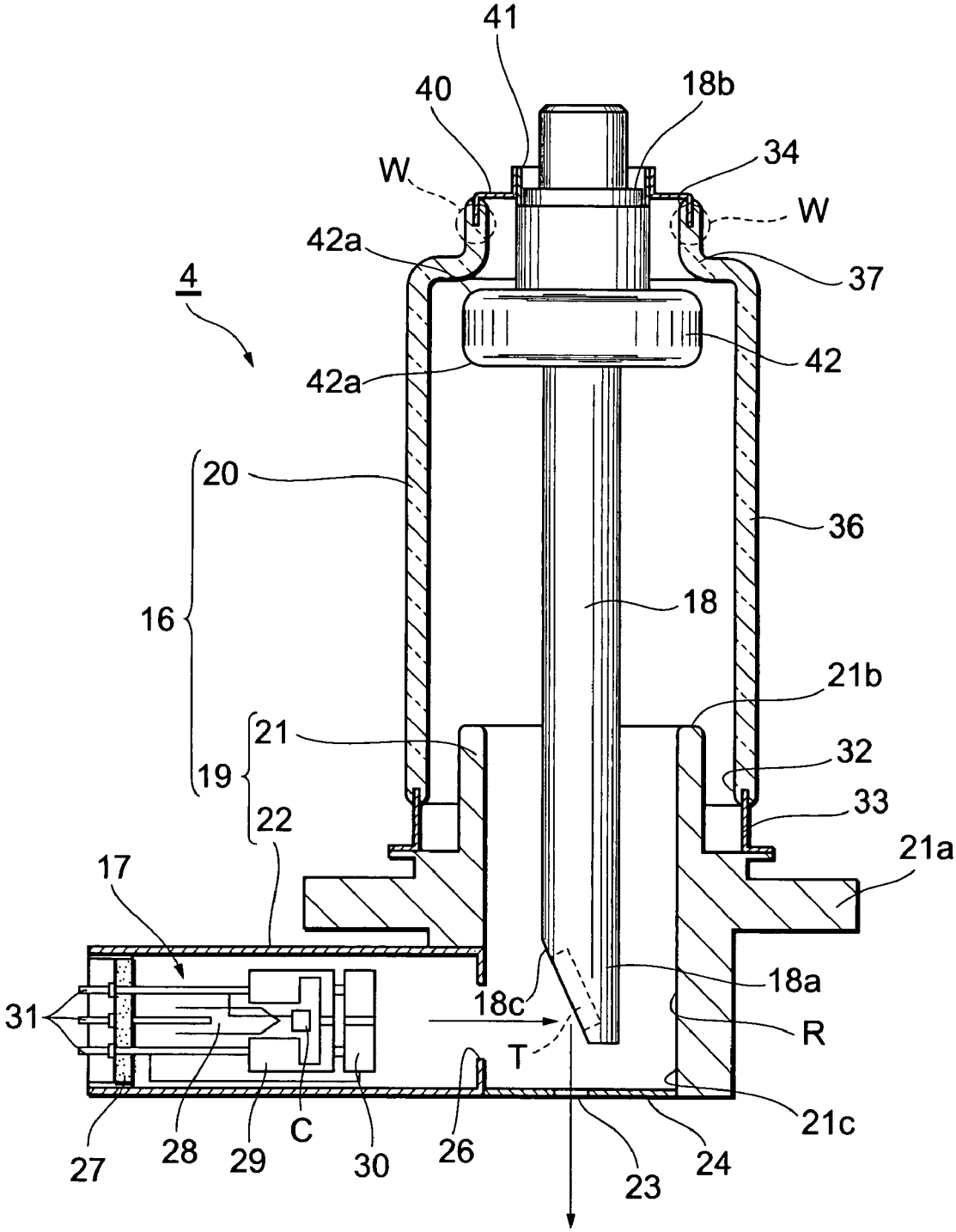
FIG. 2 is a cross-sectional view of an X-ray source according to an embodiment of the present invention.

FIG. 2 is a cross-sectional view of the X-ray tube 4. As shown in FIG. 2, the X-ray tube 4 includes a vacuum enclosure 16, an electron gun 17, and target support body 18. The vacuum enclosure 16 is comprised of enclosure main body 19 and valve 20. The metallic enclosure main body 19 is comprised of a trunk portion 21 for housing therein a target T as an anode and an electron gun housing portion 22 for housing therein the electron gun 17 as a cathode. The trunk portion 21 is formed of metal in an approximately circular cylindrical shape to have an internal space R. Also, on the outer periphery of the trunk portion 21, there is provided a flange portion 21*a* to be used for fixation to the opening portion 8*b* of the cylindrical portion 8 in the X-ray source 1. Further, in the lower end portion 21*c* of the trunk portion 21, there is provided a cover plate 24 with an output window 23 fixed thereto, the cover plate 24 covering the lower end side of the internal space R.

The electron gun housing portion 22 is formed of metal in a cross-sectionally circular cylindrical shape and joins the lower side of the trunk portion 21 air-tightly in a direction perpendicular to the trunk portion 21. The portion where the electron gun housing portion 22 and the trunk portion 21 are joined is provided with an aperture 26 that provides communication between the inside of the electron gun housing portion 22 and the internal space R of the trunk portion 21 and serves as a convergence electrode, and a stem substrate 27 is fixed to the end portion on the opposite side of the aperture 26. Also, the electron gun 17 is composed of a cathode C, a heater 28, a first grid electrode 29, and a second grid electrode 30, these components being fixed to the stem substrate 27 via a plurality of stem pins 31. Each stem pin 31 is connected to an external power supply (not shown in the drawings) to supply a predetermined voltage to the electron gun 17.

Meanwhile, the valve 20 is formed of insulating material such as glass or ceramic in an approximately circular cylindrical shape with a diameter of about 50 mm. A metallic ring member 33 joins an opening portion 32 on the one end side of the valve 20 by fusion bonding, the opening portion 32 on the one end side joining the trunk portion 21 via the ring member 33 in such a manner that the upper end portion 21*b* of the trunk portion 21 is arranged inside the valve 20. Also, the target support body 18 is formed of metal such as copper material in a rod shape with a diameter of about 15 mm, and the target T is embedded in an inclined surface 18*c* that is formed in one end portion 18*a* of the body. Then, the one end portion 18*a* of the target support body 18 is arranged in the internal space R of the trunk portion 21 in the enclosure main body 19 through the opening portion 32 on the one end side of the valve 20 in such a manner that the target T faces the electron gun 17 in the internal space R. With this arrangement, when electrons emitted from the electron gun 17 pass through the aperture 26 to come into collision with the target T in the X-ray tube 4, X-rays are generated from the surface of the target T. Then, the generated X-rays are taken out of the X-ray tube 4 through the output window 23. It is noted that the target support body 18 may be formed integrally with the target T using the same material as the target T.

Figure 3:
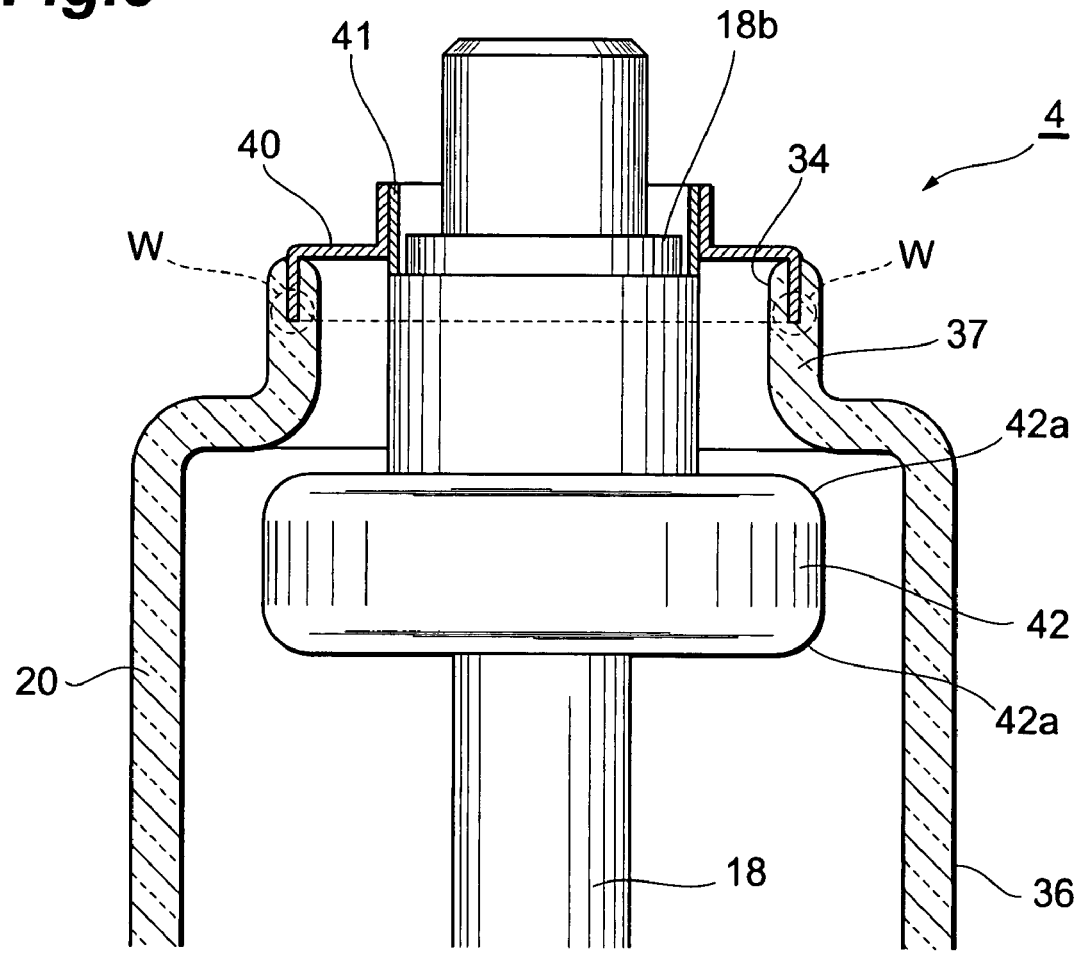
FIG. 3 is an enlarged view of the other end portion of a valve in the X-ray tube shown in FIG. 2.

Referring now to FIG. 3, the configuration of the above-described other end portion of the valve 20 will be described in more detail.

As shown in FIG. 3, the other end portion of the valve 20, which has a diameter smaller than the outside diameter of the main body portion 36 of the valve 20, is formed stepwise as a narrowed portion 37 with a diameter of about 25 mm in such a manner as to protrude from the main body portion 36. Then, the upper end of the narrowed portion 37 forms the opening portion 34 on the other end side of the valve 20. Also, a cylindrical member 40 made of metal such as kovar joins the opening portion 34 on the other end side of the valve 20 by fusion bonding. The upper end side of the cylindrical member 40 is formed stepwise to have a smaller diameter correspondingly to the outside diameter of the target support body 18, and a cylindrical member 41 made of metal such as kovar is fixed by welding to the inside of the smaller diameter portion for insertion of the other end portion 18*b* of the target support body 18. Then, the opening portion 34 on the other end side of the valve 20 is sealed by being fixed to the other end portion 18*b* of the target support body 18 via the cylindrical members 40 and 41.

The target support body 18 is further formed integrally with a metallic shield portion 42 in the vicinity of the narrowed portion 37 of the valve 20. The shield portion 42 has a circular disk shape with a diameter of about 30 mm with the major diameter (maximum diameter here) thereof being smaller than that of the main body portion 36 of the valve 20 but greater than that of the narrowed portion 37, and each corner portion 42*a* is chamfered and rounded. The shield portion 42 shields the fixation portion W where the other end portion 18*b* of the target support body 18 and the opening portion 34 on the other end side of the valve 20 are fixed to each other when viewed from the one end side of the valve 20, and particularly, the shield portion 42 shields the portion where the opening portion 34 on the other end side and the cylindrical member 40 are joined, that is, the sealed portion where insulating material and metal are joined in such a manner that the sealed portion is not seen through from the upper end portion 21*b* of the trunk portion 21 in the enclosure main body 19.

As described heretofore, in the X-ray source 1 and X-ray tube 4, the shield portion 42 is formed between the enclosure main body 19 and the opening portion 34 on the other end side of the valve 20, the shield portion 42 being adapted to shield the fixation portion W where the target support body 18 and the opening portion 34 on the other end side are fixed to each other when viewed from the one end side of the valve 20. This can suppress the generation of discharge between the one end side of the valve 20 and the fixation portion W. Also, the other end portion of the valve 20 is formed as a narrowed portion 37 and the opening portion 34 on the other end side of the valve 20 is fixed to the target support body 18, whereby the shapes of the valve 20 and the shield portion 42 can be made simpler than in conventional X-ray tubes in which an inner cylindrical portion is formed in a valve. Such a simple structure can improve the stability of an electric field in the valve 20 when generating X-rays and thereby achieve an effective suppression of the generation of discharge in the valve 20, and further can improve the radiation performance as well as reduce residual gas. Further, when fixing the target support body 18 and the opening portion 34 on the other end side of the valve 20, since operations such as welding can be performed outside the valve 20, workability and visibility are increased relative to conventional X-ray tubes in which an inner cylindrical portion is formed in a valve, which can also enhance the reliability of the X-ray tube 4 manufactured.

Also, in the X-ray source 1 and X-ray tube 4, since the shield portion 42 is formed integrally with the target support body 18, the number of parts in the valve 20 can be reduced. Therefore, processes of joining other members by welding, etc., are omitted, which makes residual metal pieces or asperities less likely to be generated in the valve 20, whereby further stability of the electric field can be achieved. Further, each corner portion 42*a* of the shield portion 42 is chamfered and rounded, which can prevent an electric field from being concentrated locally when generating X-rays. These result in suppressing the generation of discharge in the valve 20 more effectively.

Also, in the X-ray source 1 and X-ray tube 4, the target support body 18 and the opening portion 34 on the other end side of the valve 20 are joined via the cylindrical members 40 and 41. When making this joint, the cylindrical member 40 is fusion bonded to the opening portion 34 on the other end side and the cylindrical member 41 is welded to the other end portion 18*b* of the target support body 18 in advance, and finally the cylindrical members 40 and 41 are welded to each other, for example. With this arrangement, the target support body 18 can be fine-adjusted axially along the cylindrical member 40 when the cylindrical members 40 and 41 are welded, which allows the target T to be aligned accurately with respect to the electron gun 17.

Further, in the X-ray source 1, when connecting the X-ray tube 4 and the high-voltage power supply unit 3, the fixation portion W where the opening portion 34 on the other end side of the valve 20 and the target support body 18 are fixed to each other is surrounded and shielded by the high-voltage cap 12 so as not to be seen through from the inner wall of the cylindrical portion 8. This can suppress the generation of discharge between the X-ray tube 4 and the inner wall of the cylindrical portion 8 when generating X-rays.

Furthermore, in the X-ray source 1, the cylindrical portion 8 is fixed to the insulating block 9, the valve 20 in the X-ray tube 4 is housed in the cylindrical portion 8, and the high-voltage cap 12 surrounds the fixation portion W in such a manner that the fixation portion W is not seen through from the inner wall of the cylindrical portion 8. Since this can improve the radiation performance of the X-ray tube 4 when generating X-rays, the generation of discharge in the X-ray tube 4 can be suppressed. In addition, since the high-voltage cap 12 surrounds the fixation portion W, the generation of discharge between the X-ray tube 4 and the inner wall of the cylindrical portion 8 can be suppressed. Further, the high-voltage cap 12 has the wall portion 12*a* that extends along the tube axis direction of the X-ray tube 4, and the wall portion 12*a* surrounds the fixation portion W in such a manner that the fixation portion W is not seen through from the inner wall of the cylindrical portion 8. Thus, an electric field in the vicinity of the fixation portion W cannot be disturbed, whereby the generation of discharge can be suppressed more effectively.

It is noted that the present invention is not restricted to the above-described embodiment, and various modifications may be made. For example, although the shield portion 42 has a circular disk shape with each corner portion 42*a* being chamfered and rounded in an R-shape in the above-described embodiment, the shield portion may have a shape with no corner portion such as spherical or ellipsoidal.

Figure 4:
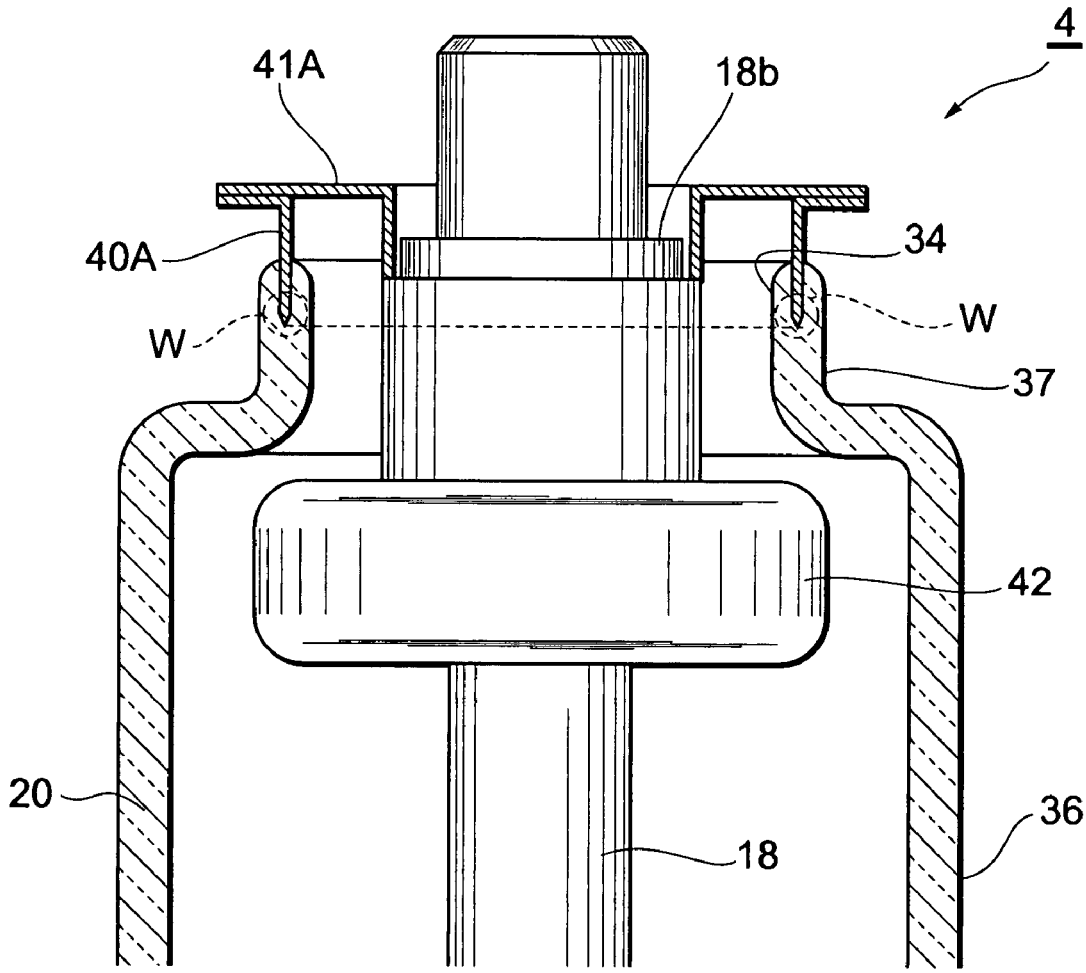
FIG. 4 is an enlarged view of the other end portion of a valve in an X-ray tube according to an exemplary variation.
Figure 5:
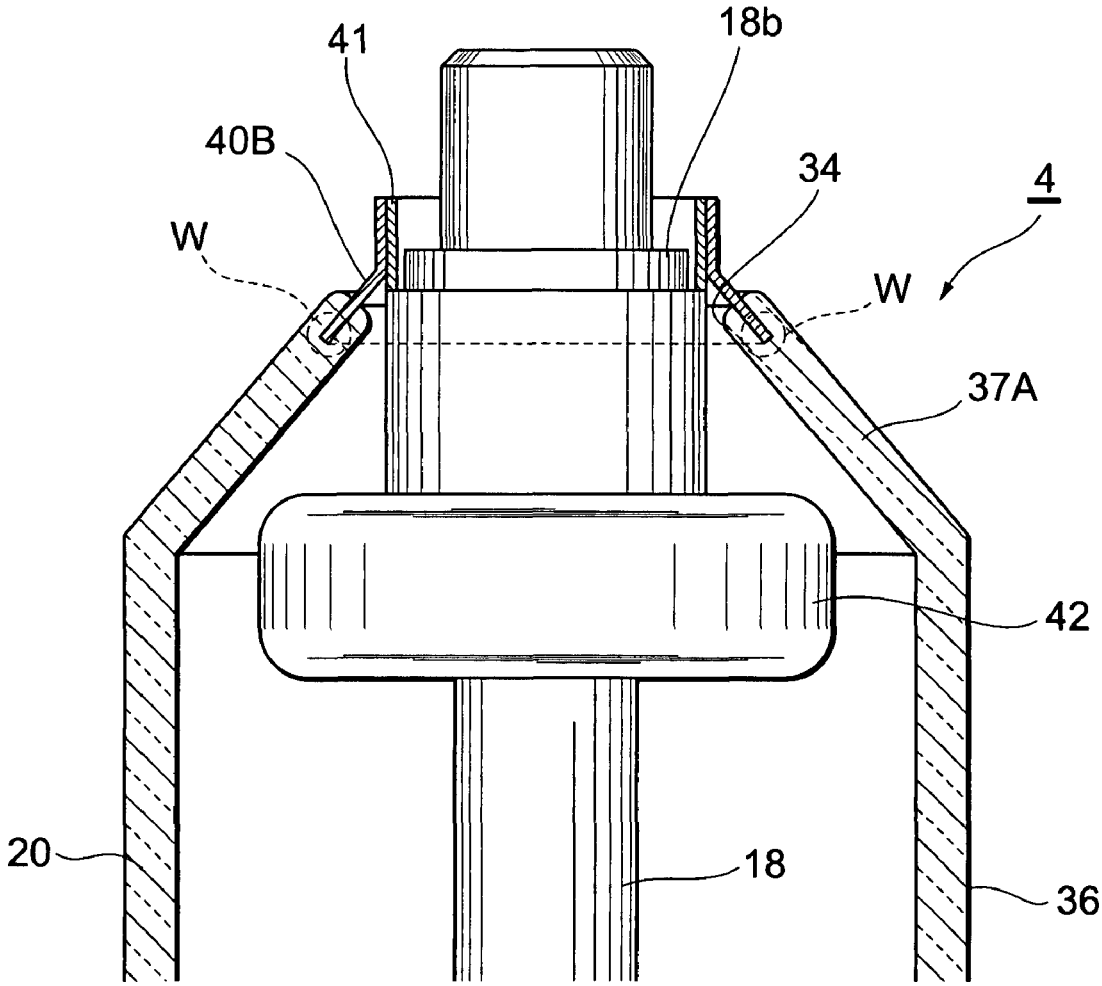
FIG. 5 is an enlarged view of the other end portion of a valve in an X-ray tube according to another exemplary variation.
Figure 6:
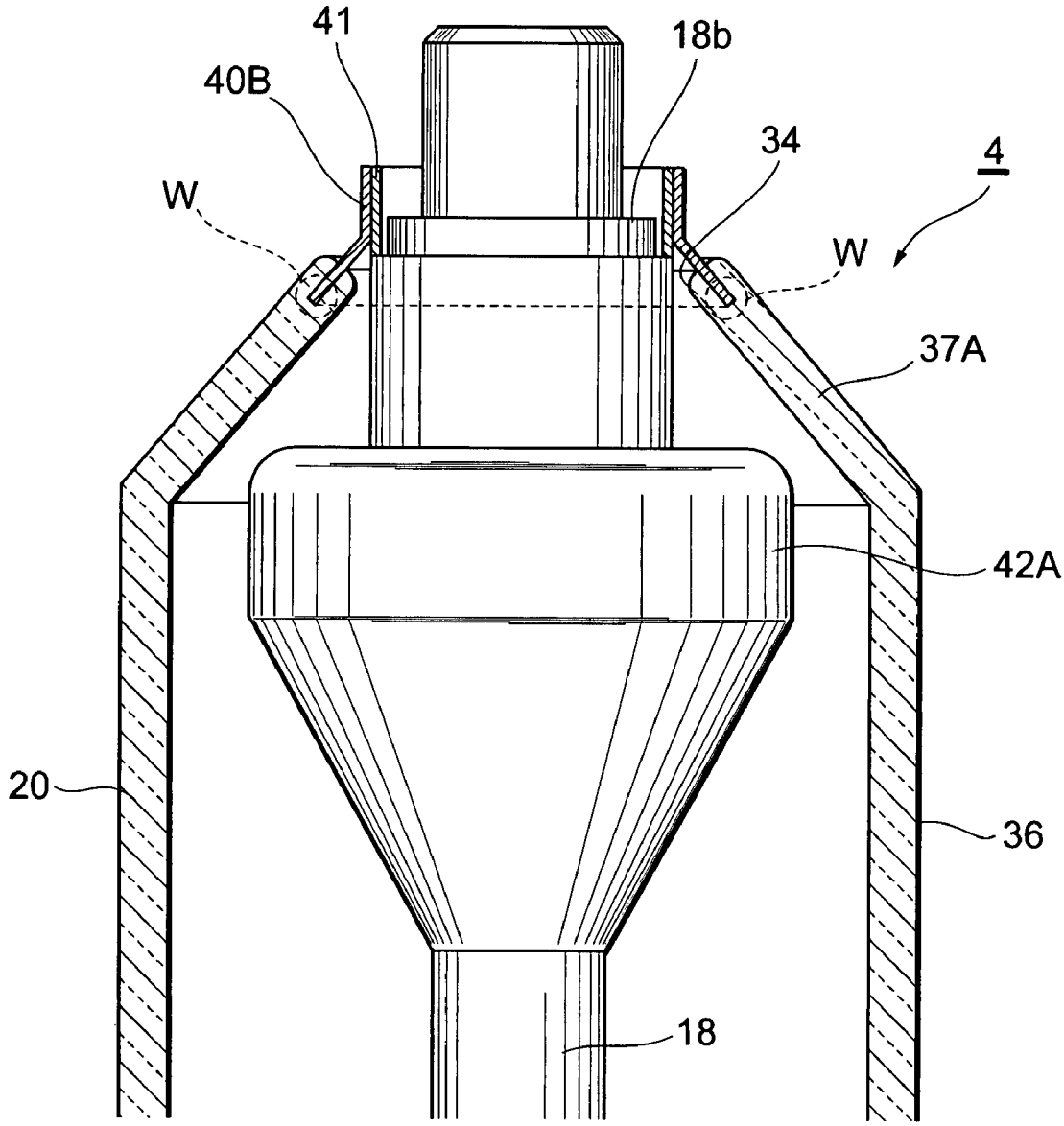
FIG. 6 is an enlarged view of the other end portion of a valve in an X-ray tube according to a further exemplary variation.

Also, as shown in FIG. 4, cylindrical members 40A and 41A each having a flange may be employed as cylindrical members. In this case, the flanges of the cylindrical members 40A and 41A can be overlapped and fixed to each other by welding. Further, as shown in FIG. 5, the other end portion of the valve 20 may be formed as a narrowed portion 37A with the diameter thereof being reduced in a tapered manner. In this case, it is preferable to employ a cylindrical member 40B with the diameter thereof being reduced in a tapered manner correspondingly to the shape of the narrowed portion 37A, in which the major diameter (maximum diameter here) of the shield portion 42 is smaller than that of the main body portion 36 of the valve 20 but greater than that of the fixation portion W at the narrowed portion 37A. In addition, as shown in FIG. 6, the narrowed portion 37A may be combined with a shield portion 42A that is formed with the diameter thereof being increased gradually from one end side to the other end side of the target support body 18. In this case, the maximum diameter of the shield portion 42A is preferably smaller than that of the main body portion 36 of the valve 20 but greater than that of the fixation portion W at the narrowed portion 37A. Also in these exemplary variations, the same effects as in the above-described embodiment can be obtained.

The invention claimed is:

1. An X-ray tube for bringing electrons emitted from an electron gun into collision with a target to generate X-rays, comprising:

a metallic enclosure main body for housing therein the electron gun;

a cylindrical valve, formed of an insulating material, with an opening portion on one end side thereof being fixed to the enclosure main body, while the other end side thereof is formed as a narrowed portion having a fixation portion, wherein the fixation portion is not surrounded by the valve; and a target support body inserted in the valve to support the target, wherein an opening portion on the other end side of the valve is fixed to the target support body, and a shield portion is formed between the enclosure main body and the opening portion on the other end side of the valve, the shield portion being adapted to shield the fixation portion where the target support body and the opening portion on the other end side of the valve are fixed to each other when viewed from the one end side of the valve.

2. The X-ray tube according to claim 1, wherein the shield portion is formed integrally with the target support body.

3. The X-ray tube according to claim 1, wherein the shield portion is formed to have rounded corner portions.

4. An X-ray source comprising a chassis for housing therein the X-ray tube according to claim 1 and a high-voltage power supply unit for supplying a voltage to the target support body in the X-ray tube, wherein the portion where the target support body and the opening portion on the other end side of the valve are fixed to each other is surrounded by a surrounding member.

5. The X-ray source according to claim 4, wherein the chassis comprises:

an insulating block with the high-voltage power supply unit embedded therein; and a metallic cylindrical portion fixed to the insulating block and filled with insulating liquid material inside, and wherein the valve in the X-ray tube is housed in the cylindrical portion, and the surrounding member surrounds the fixation portion in such a manner that the fixation portion is not seen through from an inner wall of the cylindrical portion.

6. The X-ray source according to claim 5, wherein the surrounding member has a wall portion extending along a tube axis direction of the X-ray tube, and the wall portion surrounds the fixation portion in such a manner that the fixation portion is not seen through from the inner wall of the cylindrical portion.

7. The X-ray tube according to claim 1, wherein the narrowed portion is formed in a step shape in a longitudinal direction of the valve such that a diameter of the narrowed portion is smaller than a diameter of a main body portion of the valve.

8. The X-ray tube according to claim 1, wherein the narrowed portion is formed in a tapered shape in a longitudinal direction of the valve such that a diameter of the narrowed portion is smaller than a diameter of a main body portion of the valve.

9. The X-ray tube according to claim 1, wherein an end portion of the cylindrical member is embedded with the opening portion on the other end side of the valve.

10. The X-ray tube according to claim 1, further comprising:

a cylindrical member joining the opening portion on the other end side of the valve in which the target support body is inserted, wherein the opening portion on the other end side of the valve is fixed to the target support body via the cylindrical member, and an end portion of the target support body does not contact an inner surface of the valve.

11. The X-ray tube according to claim 10, wherein an end portion of the cylindrical member is embedded with the opening portion on the other end side of the valve.

12. An X-ray tube for bringing electrons emitted from an electron gun into collision with a target to generate X-rays, comprising:

a metallic enclosure main body for housing therein the electron gun;

a cylindrical valve, formed of an insulating material, with an opening portion on one end side thereof being fixed to the enclosure main body, while the other end side thereof is formed as a narrowed portion having a fixation portion, wherein the fixation portion is not surrounded by the valve; and a target support body having a rod shape inserted in the valve to support the target on the one end side thereof, while the other end side of the target support body is foamed as having a maximum diameter portion, wherein an opening portion on the other end side of the valve that is formed as the narrowed portion is fixed at the fixation portion to the target support body, and an outer diameter of the maximum diameter portion is greater than an inner diameter of the narrowed portion.

13. The X-ray tube according to claim 12, wherein the narrowed portion is formed in a step shape in a longitudinal direction of the valve such that the inner diameter of the narrowed portion is smaller than an inner diameter of a main body portion of the valve.

14. The X-ray tube according to claim 12, wherein the narrowed portion is formed in a tapered shape in a longitudinal direction of the valve such that the inner diameter of the narrowed portion is smaller than an inner diameter of a main body portion of the valve.

15. The X-ray tube according to claim 12, wherein an end portion of the cylindrical member is embedded with the opening portion on the other end side of the valve.

16. The X-ray tube according to claim 12, further comprising:

a cylindrical member joining the opening portion on the other end side of the valve in which the target support body is inserted, wherein the opening portion on the other end side of the valve is fixed to the target support body via the cylindrical member, and an end portion of the target support body does not contact an inner surface of the valve.

17. The X-ray tube according to claim 16, wherein an end portion of the cylindrical member is embedded with the opening portion on the other end side of the valve.

* * * * *